US008640285B2

(12) United States Patent
Heimbrock et al.

(10) Patent No.: US 8,640,285 B2
(45) Date of Patent: Feb. 4, 2014

(54) HOSPITAL BED SEAT SECTION ARTICULATION FOR CHAIR EGRESS

(75) Inventors: Richard H. Heimbrock, Cincinnati, OH (US); Jonathan D. Turner, Dillsboro, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 397 days.

(21) Appl. No.: 12/951,169

(22) Filed: Nov. 22, 2010

(65) Prior Publication Data

US 2012/0124745 A1 May 24, 2012

(51) Int. Cl.
*A47B 7/02* (2006.01)

(52) U.S. Cl.
USPC ..... 5/618; 5/610; 5/612

(58) Field of Classification Search
USPC ..... 5/600, 610, 612, 613, 616–618
See application file for complete search history.

(56) References Cited

U.S. PATENT DOCUMENTS

| | | | | |
|---|---|---|---|---|
| 346,246 | A | 7/1886 | Uhde | |
| 3,336,606 | A | 8/1967 | Beitzel | |
| 3,406,772 | A | 10/1968 | Ahrent et al. | |
| 3,793,652 | A | 2/1974 | Linehan et al. | |
| 4,076,304 | A | 2/1978 | Deucher | |
| 4,227,269 | A | 10/1980 | Johnston | |
| 4,847,929 | A | 7/1989 | Pupovic | |
| 4,862,529 | A | 9/1989 | Peck | |
| 5,023,967 | A | 6/1991 | Ferrand | |
| 5,072,463 | A | 12/1991 | Willis | |
| 5,095,561 | A | 3/1992 | Green et al. | |
| 5,203,610 | A | 4/1993 | Miller | |
| 5,230,113 | A | 7/1993 | Foster et al. | |
| 5,279,010 | A | 1/1994 | Ferrand et al. | |
| 5,398,357 | A | 3/1995 | Foster | |
| 5,577,279 | A | 11/1996 | Foster et al. | |
| 5,715,548 | A | 2/1998 | Weismiller et al. | |
| 5,906,016 | A | 5/1999 | Ferrand et al. | |
| 6,163,903 | A * | 12/2000 | Weismiller et al. | 5/610 |
| 6,185,769 | B1 | 2/2001 | Larisey, Jr. et al. | |
| 6,315,319 | B1 | 11/2001 | Hanson et al. | |
| 6,353,949 | B1 | 3/2002 | Falbo | |
| 6,505,365 | B1 | 1/2003 | Hanson et al. | |
| 6,846,042 | B2 * | 1/2005 | Hanson et al. | 297/411.36 |
| 6,957,461 | B2 | 10/2005 | Osborne et al. | |
| 7,086,103 | B2 | 8/2006 | Barthelt | |
| 7,165,277 | B2 | 1/2007 | Taguchi et al. | |
| 7,234,178 | B2 | 6/2007 | Qi | |
| 7,296,312 | B2 | 11/2007 | Menkedick et al. | |
| 7,319,386 | B2 | 1/2008 | Collins, Jr. et al. | |
| 7,373,677 | B2 | 5/2008 | Barthelt | |
| 7,538,659 | B2 | 5/2009 | Ulrich et al. | |
| 7,676,862 | B2 | 3/2010 | Poulos et al. | |

(Continued)

*Primary Examiner* — Robert G Santos
*Assistant Examiner* — Richard G Davis
(74) *Attorney, Agent, or Firm* — Barnes & Thornburg LLP

(57) ABSTRACT

A hospital bed includes a base, an upper frame supported above the base, and a deck supported on the upper frame. The deck has head, seat, thigh, and foot sections. The deck is movable between a horizontal position to support a patient in a supine position and a chair egress position to support the patient in a sitting position. The hospital bed further has a seat section actuator to articulate the seat section relative to the upper frame about an axis located adjacent a foot end of the seat section such that a head end of the seat section lifts upwardly relative to the upper frame to facilitate egress of the patient from the deck when the deck is in the chair egress position.

20 Claims, 9 Drawing Sheets

(56) References Cited

U.S. PATENT DOCUMENTS

| | | | | |
|---|---|---|---|---|
| 7,784,121 | B2 * | 8/2010 | Ahlman | 5/81.1 R |
| 7,788,748 | B2 * | 9/2010 | Wurdeman | 5/600 |
| 8,336,140 | B2 * | 12/2012 | Parson et al. | 5/619 |
| 2002/0178502 | A1 * | 12/2002 | Beasley et al. | 5/618 |
| 2005/0076440 | A1 * | 4/2005 | Taguchi et al. | 5/618 |
| 2006/0096029 | A1 * | 5/2006 | Osborne et al. | 5/618 |
| 2006/0162079 | A1 * | 7/2006 | Menkedick et al. | 5/624 |
| 2007/0180621 | A1 * | 8/2007 | Turner et al. | 5/618 |
| 2007/0210917 | A1 | 9/2007 | Collins, Jr. et al. | |
| 2008/0148484 | A1 * | 6/2008 | Hornbach et al. | 5/601 |
| 2008/0289108 | A1 * | 11/2008 | Menkedick et al. | 5/610 |
| 2009/0044339 | A1 | 2/2009 | Morin et al. | |
| 2009/0212925 | A1 | 8/2009 | Schuman, Sr. et al. | |
| 2009/0212926 | A1 | 8/2009 | Du et al. | |
| 2009/0217080 | A1 | 8/2009 | Ferguson et al. | |
| 2010/0005591 | A1 * | 1/2010 | Manouchehri | 5/611 |
| 2010/0064439 | A1 * | 3/2010 | Soltani | 5/611 |
| 2010/0095456 | A1 * | 4/2010 | Parson et al. | 5/618 |
| 2010/0293718 | A1 * | 11/2010 | Wurdeman | 5/611 |
| 2012/0144588 | A1 * | 6/2012 | Heimbrock et al. | 5/624 |
| 2012/0198626 | A1 * | 8/2012 | Richards | 5/607 |
| 2013/0007960 | A1 * | 1/2013 | Manouchehri et al. | 5/618 |

* cited by examiner

HOSPITAL BED SEAT SECTION ARTICULATION FOR CHAIR EGRESS

BACKGROUND

The present disclosure relates to patient support apparatuses, such as hospital beds. More particularly, the present disclosure relates to patient support apparatuses having mattress support decks that are movable between horizontal and chair egress positions.

Patient support apparatuses, such as hospital beds, that have articulated decks which move between horizontal and chair egress positions are known. The TOTALCARE® bed marketed by Hill-Rom Company, Inc. is one such bed. Beds are moved to the chair egress position to facilitate a patient's ability to egress from the bed and stand up in a manner similar to standing up from a chair. However, some patients may still have difficulty standing up from beds even when the beds are in the chair egress position. One reason for the difficulty, in some instances, is the depth of the seating surface formed in the longitudinal dimension of the bed by a seat section and a thigh section of the bed. Accordingly, a need persists in improving bed features and functions that further facilitate patient egress from beds that have mattress support decks which are movable between horizontal positions and chair egress positions.

SUMMARY

A patient support apparatus, such as a hospital bed, has one or more of the features recited in the appended claims and/or the following features which, alone or in any combination, may comprise patentable subject matter:

A hospital bed may have a base, an upper frame supported above the base, and a deck supported on the upper frame. The deck may have one or more sections, such as a head section, a seat section, a thigh section, and a foot section. The deck may be movable between a horizontal position to support a patient in a supine position and a chair egress position to support the patient in a sitting position. The hospital bed may further have a seat section actuator coupled to the seat section and operable to articulate the seat section relative to the upper frame about an axis located adjacent a foot end of the seat section such that a head end of the seat section lifts upwardly relative to the upper frame to facilitate egress of the patient from the deck when the deck is in the chair egress position.

In some embodiments, the head section may be coupled to the seat section adjacent the head end of the seat section. A head section actuator may be provided and may operate to increase an angle defined between the head section and the seat section as the seat section actuator lifts the head end of the seat section upwardly relative to the upper frame. The head section actuator may have a first end coupled to a first link extending from the head section and a second end coupled to a second link extending from the seat section, for example.

In other embodiments, the head section may be coupled to the upper frame for pivoting movement about a head section axis that remains stationary relative to the upper frame as the head end of the seat section lifts upwardly relative to the upper frame. Thus, a gap between the head end of the seat section and a foot end of the head section may increase in size as the seat section lifts upwardly relative to the upper frame. In still further embodiments, the head section may be coupled to the upper frame for pivoting movement about a laterally extending head section axis that translates longitudinally relative to the upper frame as the head end of the seat section lifts upwardly relative to the upper frame and as the head section pivots upwardly relative to the upper frame during movement of the deck from the horizontal position to the chair egress position.

The head section actuator may have a first end pivotably coupled to the head section and a second end pivotably coupled to the upper frame in some embodiments. The seat section actuator may have a first end pivotably coupled to the seat section and a second end pivotably coupled to the upper frame.

According to some contemplated embodiments, the foot section may moves through an angle greater than 90 degrees as the deck moves between the horizontal and chair egress positions. The foot section may move through the angle greater than 90 degrees due to pivoting of the foot section relative to the thigh section and due to the upper frame being tilted relative to the base.

In some embodiments, the thigh section may be U-shaped so as to define a central gap in the thigh section and the seat section may be T-shaped with an extension portion received in the central gap when the deck is in the horizontal position. In such embodiments, the axis about which the seat section articulates to lift the head end of the seat section upwardly may be situated adjacent a foot end of the extension portion. The thigh section may be pivotable upwardly to a knee gatch position relative to the upper frame about a thigh section axis located adjacent a head end of the thigh section such that a majority of the central gap of the thigh section moves to a position above the extension portion of the seat section. The hospital bed may have a mattress with a portion of the mattress bridging across the central gap when the thigh section is in the knee gatch position. In other embodiments, the thigh section may be T-shaped and the seat section may be U-shaped. In still further embodiments, the seat section may be U-shaped and the thigh section may comprise a rectangular section that occupies a central gap in the U-shaped seat section when the thigh and seat sections are in a coplanar orientation.

The hospital bed may further have a head section actuator to move the head section, a thigh section actuator to move the thigh section and a foot section actuator to move the foot section. However, an inclination of the thigh section may remain stationary relative to the upper frame as the deck moves between the horizontal and chair egress positions in some embodiments. The foot section may include a first portion, a second portion that is extendable and retractable relative to the first portion, and an extension actuator to extend and retract the second portion relative to the first portion.

The axis about which the seat section articulates relative to the upper frame may remain at a fixed position relative to the upper frame during seat section articulation. The upper frame may include a pair of spaced apart, longitudinally extending frame members and the seat section may include a pair of outer lateral portions that rest upon the longitudinally extending frame members of the upper frame when the deck is in the horizontal position. The pair of outer lateral portions of the seat section may move upwardly away from the longitudinally extending frame members when the seat section articulates as the deck moves toward the chair egress position.

Additional features, which alone or in combination with any other feature(s), such as those listed above and those listed in the claims, may comprise patentable subject matter and will become apparent to those skilled in the art upon consideration of the following detailed description of various embodiments exemplifying the best mode of carrying out the embodiments as presently perceived.

BRIEF DESCRIPTION OF THE DRAWINGS

The detailed description particularly refers to the accompanying figures in which.

DETAILED DESCRIPTION

Figure 1:
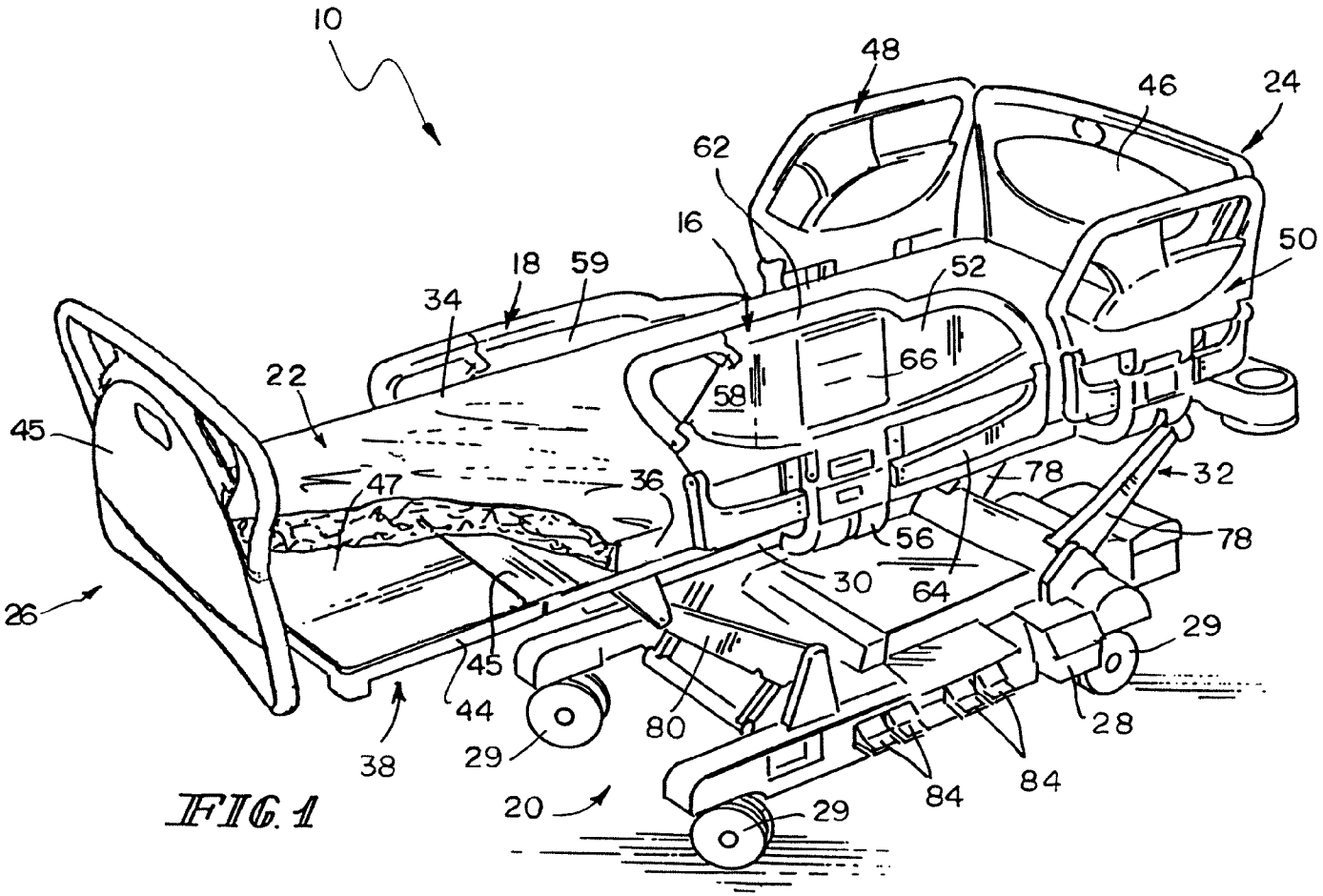
FIG. 1 is a perspective view of a hospital bed having a mattress support deck in a horizontal position and having three of four siderails in a raised position with a fourth of the four siderails in a lowered position.
Figure 2:
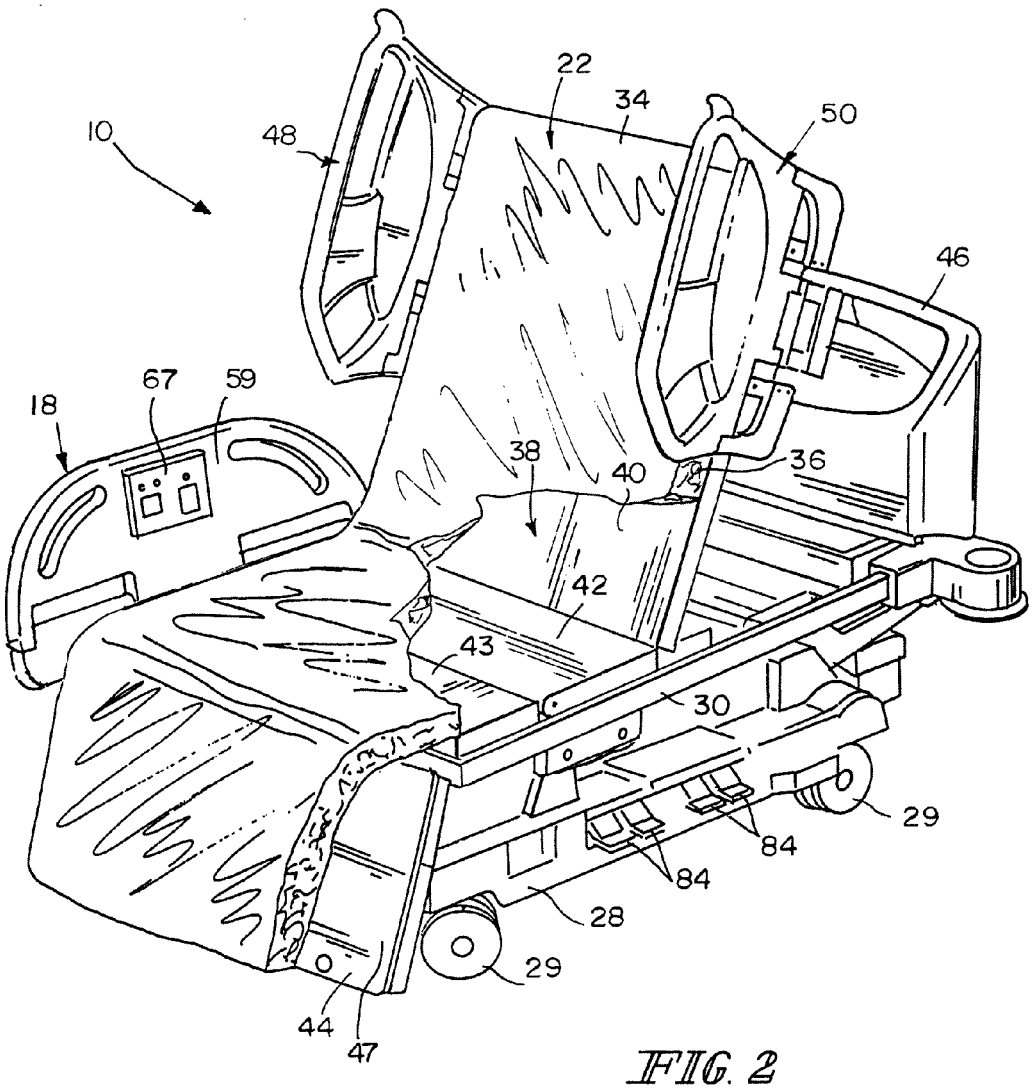
FIG. 2 is a perspective view of the hospital bed of FIG. 1 having the mattress support deck in a chair egress position with portions of a mattress broken away and one of the siderails removed from the bed to expose head, seat, thigh and foot sections of the mattress support deck.

According to this disclosure, a patient support apparatus, such as an illustrative hospital bed 10, has mattress support deck articulation features and functions that assist a patient in standing up from the bed. Illustrative bed 10 is a so-called chair bed that is movable between a bed position as shown in FIG. 1 and a chair egress position as shown in FIG. 2. However, the teachings of this disclosure are applicable to other types of patient support apparatuses such as stretchers, motorized chairs, operating room (OR) tables, specialty surgical tables such as orthopedic surgery tables, examination tables, and the like.

Referring now to FIGS. 1 and 2, hospital bed 10 provides support to a patient (not shown) lying in a horizontal position when bed 10 is in the bed position shown in FIG. 1. In the chair egress position, hospital bed 10 supports the patient in a sitting position such that the patient sits on bed 10 with the patient's feet positioned on an underlying floor. Thus, the chair egress position is often used by patients and caregivers to help patients egress or exit the hospital bed 10. Hospital bed 10 includes a frame 20 that supports a mattress 22 as shown in FIGS. 1 and 2. Bed 10 has a head end 24 and a foot end 26.

Frame 20 includes a base 28 and an upper frame 30 coupled to the base 28 by a lift system 32. Lift system 32 is operable to raise, lower, and tilt upper frame 30 relative to base 28. Hospital bed 10 further includes a footboard 45 at the foot end 26 and a headboard 46 at the head end 24. Footboard 45 is removed prior to bed 10 being moved into the chair egress position as shown in FIG. 2. Base 28 includes wheels or casters 29 that roll along floor as bed 10 is moved from one location to another.

Illustrative hospital bed 10 has four siderail assemblies coupled to upper frame 30: a patient-right head siderail assembly 48, a patient-right foot siderail assembly 18, a patient-left head siderail assembly 50, and a patient-left foot siderail assembly 16. Each of the siderail assemblies 16, 18, 48, and 50 is movable between a raised position, as the left foot siderail assembly 16 is shown in FIG. 1, and a lowered position, as the right foot siderail assembly 18 is shown in FIG. 1. Siderail assemblies 16, 18, 48, 50 are sometimes referred to herein as siderails 16, 18, 48, 50.

The left foot siderail assembly 16 is similar to the other siderail assemblies 18, 48, 50, and thus, the following discussion of the left foot siderail assembly 16 is equally applicable to the other siderail assemblies 18, 48, 50 unless specifically noted otherwise. The left foot siderail 16 includes a barrier panel 52 and a linkage 56. Linkage 56 is coupled to the upper frame 30 and is configured to guide barrier panel 52 during movement of the foot siderail 16 between the raised and lowered positions. Barrier panel 52 is maintained by the linkage 56 in a substantially vertical orientation during movement of siderail 16 between the raised and lowered positions. The barrier panel 52 includes an outward side 58, an oppositely facing inward side 59, a top portion 62, and a bottom portion 64.

A user interface 66 is coupled to the outward side 58 of barrier panel 52 for use by a caregiver (not shown). The inward side 59 faces opposite the outward side 58. As shown in FIG. 2, another user interface 67 is coupled to the inward side 59 for use by the patient. In the illustrative embodiment, user interface 66 is a touchscreen display.

Mattress 22 includes a top surface 34, a bottom surface (not shown), and a perimeter surface 36 as shown in FIGS. 1 and 2. The upper frame 30 carries a mattress support deck 38 of frame 20 that engages the bottom surface of mattress 22. The support deck 38, as shown for example in FIG. 2 and as shown diagrammatically in FIG. 11, includes a head section 40, a seat section 42, a thigh section 43 and a foot section 44. Each of sections 40, 42, 43, 44 is movable relative to upper frame 30. For example, in a first embodiment, head section 40 pivotably raises and lowers relative to seat section 42 whereas foot section 44 pivotably raises and lowers relative to thigh section 43. Additionally, thigh section 43 articulates relative to seat section 42. Also, in the illustrative embodiment of FIGS. 1 and 2, foot section 44 is extendable and retractable to change the overall length of foot section 44 and therefore, to change the overall length of deck 38. For example, foot section 44 includes a main portion 45 and an extension 47 in some embodiments as shown diagrammatically in FIG. 11.

As bed 10 moves from the bed position to the chair egress position, foot section 44 lowers relative to thigh section 43 and shortens in length due to retraction of the extension 47 relative to main portion 45. As bed 10 moves from the chair egress position to the bed position, foot section 44 raises relative to thigh section 43 and increases in length due to extension of the extension 47 relative to main portion 45. Thus, in the chair egress position, head section 40 extends generally vertically upwardly from upper frame 30 and foot section extends generally vertically downwardly from thigh section 43 as shown in FIG. 2. In the bed position, mattress support deck 38 and upper frame 30 are in a horizontal position.

Figure 11:
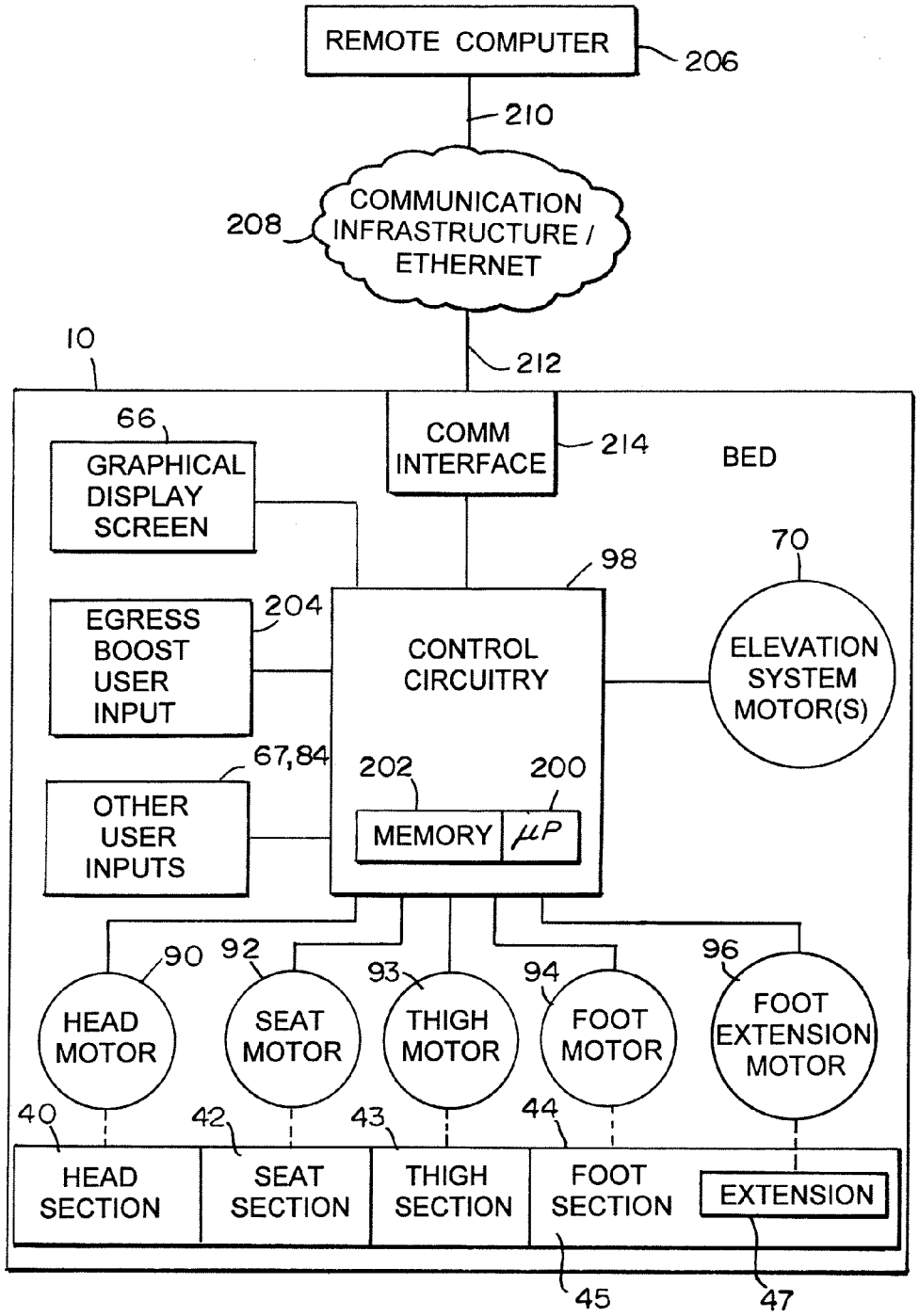
FIG. 11 is a simplified block diagram of an electrical system of a hospital bed showing the electrical system including an egress boost user input that is used to command various actuators to place the mattress support deck in the egress boost position.

As shown diagrammatically in FIG. 11, bed 10 includes a head motor or actuator 90 coupled to head section 40, a seat motor or actuator 92 coupled to seat section 42, a thigh motor or actuator 93 coupled to thigh section 43, a foot motor or actuator 94 coupled to foot section 44, and a foot extension motor or actuator 96 coupled to foot extension 47. Motors 90, 92, 93, 94, 96 may include, for example, an electric motor of a linear actuator. Head motor 90 is operable to raise and lower head section 40, seat motor 92 is operable to raise and lower seat section 42, knee motor 93 is operable to articulate thigh section 43 relative to seat section 42, foot motor 94 is operable to raise and lower foot section 44 relative to thigh section 43, and foot extension motor 96 is operable to extend and retract extension 47 of foot section 44 relative to main portion 44 of foot section 44.

In some embodiments, bed 10 includes an integrated air system that controls inflation and deflation of various air bladders or cells (not shown) of mattress 22. In response to use of one or more of motors 90, 92, 93, 94, 96 one or more of the bladders of mattress 22 may be inflated or deflated. In some embodiments, for example, in response to raising head section 40, the integrated air system inflates one or more bladders supported above seat section 42 to prevent or lessen the chance of the patient bottoming out on the seat section 42. Bottoming out refers to the situation in which a patient completely crushes or deforms a mattress bladder to the extent that the patient feels the underlying deck section. As another example, in some embodiments, in response to extension 47 being retracted relative to main portion 45 of foot section, the integrated air system deflates bladders associated with foot section 44 to accommodate the shortening of foot section 44. In such embodiments, in response to extension 47 being extended relative to main portion 45, air bladders associated with foot section 44 are inflated by the integrated air system.

Figure 10:
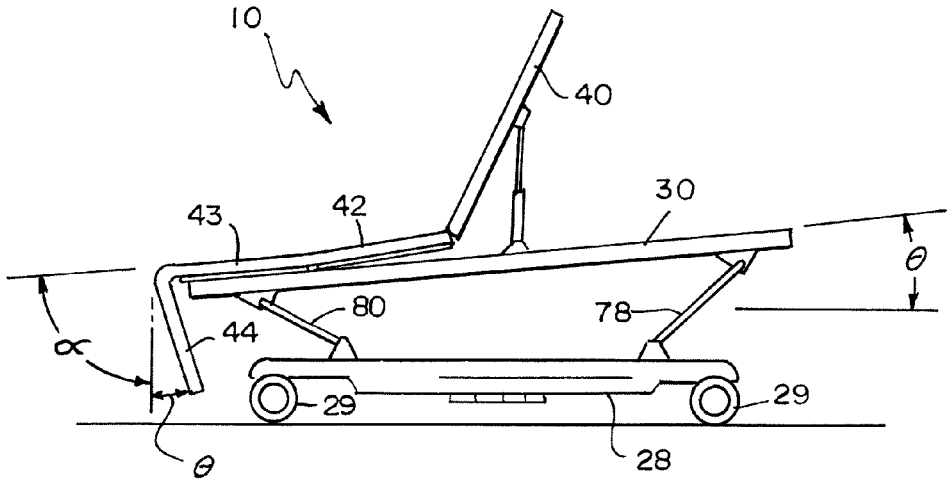
FIG. 10 is a diagrammatic side view of an alternative embodiment of a hospital bed showing a mattress support deck in a chair egress position, an upper frame of the hospital bed tilted to a reverse Trendelenburg position, and a foot section of the mattress support deck pivoted by an angle greater than 90 degrees relative to a thigh section of the mattress support deck.

As also shown diagrammatically in FIG. 11, lift system 32 of bed 10 includes one or more elevation system motors or actuators 70, which in some embodiments, comprise linear actuators with electric motors. Thus, actuators 70 are sometimes referred to herein as motors 70. Alternative actuators or motors contemplated by this disclosure include hydraulic cylinders and pneumatic cylinders, for example. The motors 70 of lift system 32 are operable to raise, lower, and tilt upper frame 30 relative to base 28. In the illustrative embodiment, one of motors 70 is coupled to, and acts upon, a set of head end lift arms 78 and another of motors 70 is coupled to, and acts upon, a set of foot end lift arms 80 (only one of which can be seen in FIG. 1) to accomplish the raising, lowering and tilting functions of upper frame 30 relative to base 28. As bed 10 moves from the horizontal bed position of FIG. 1 to the chair egress position of FIG. 2, motors 70 are operated to move arms 78, 80 to lower upper frame 30 toward base 20 if frame 30 is in a raised position initially. In some embodiments, motors 70 are operated so as to tilt upper frame by a slight amount, e.g., by 2° to 5°, toward the reverse Trendelenburg position such that the foot end of upper frame 30 is slightly lower than the head end of frame 30. Such an embodiment is shown in FIG. 10 which is discussed in further detail below.

In the illustrative example, bed 10 has four foot pedals 84 coupled to base 28 on each side of base 28. A first of pedals 84 is depressed to raise upper frame 30 relative to base 28, a second of pedals 84 is used to lower frame 30 relative to base 28, a third of pedals 84 is used to raise head section 40 relative to upper frame 30, and a fourth of pedals 84 is used to lower head section 40 relative to upper frame 30. In other embodiments, foot pedals 84 are omitted.

Figure 3:
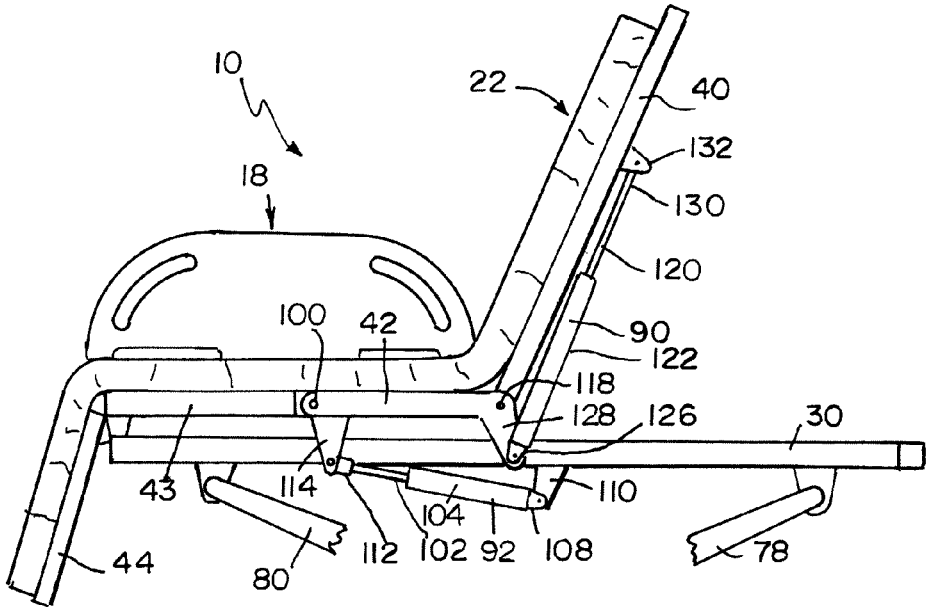
FIG. 3 is a diagrammatic side view of a portion of the hospital bed of FIGS. 1 and 2 showing the mattress support deck in the chair egress position with the seat and thigh sections in generally horizontal positions on an upper frame of the hospital bed.
Figure 4:
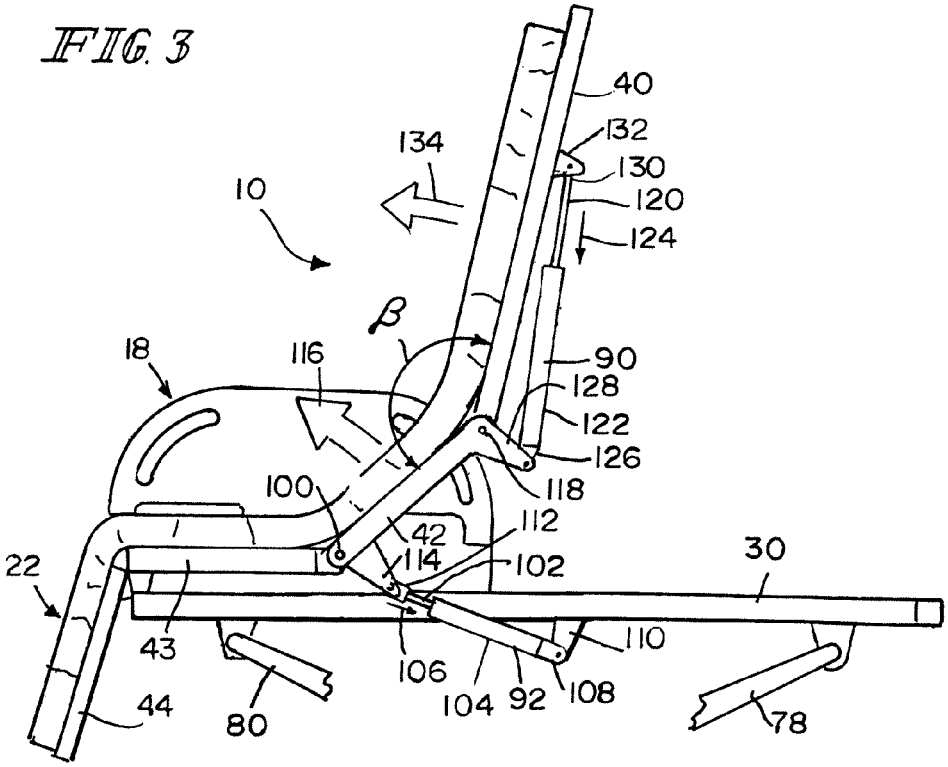
FIG. 4 is a diagrammatic side view, similar to FIG. 3, showing the mattress support deck in an egress boost position having the seat section pivoted upwardly about a foot end axis of the seat section and the head section pivoted relative to a head end of the seat section to increase an angle defined between the head section and seat section.

Referring now to FIGS. 3 and 4, bed 10 has an egress boost feature to further assist a patient in standing up from bed 10. During egress boost, seat actuator 92 is actuated so that seat section 42 pivots about an axis 100 that is located near the foot end of seat section 42 which causes the head end of seat section 42 to raise upwardly relative to upper frame 30 as shown in FIG. 4. Thus, seat section 42 moves from a horizontal position, shown in FIG. 3, to an egress boost position, shown in FIG. 4, when the egress boost feature of bed 10 is operated. As seat section 42 moves in this manner, an output shaft 102 of actuator 92 retracts into a housing 104 of actuator 92 in the direction of arrow 106, shown in FIG. 4.

A first end 108 of actuator 92 is pivotably coupled to a flange 110 extending downwardly from upper frame 30 and a second end 112 of actuator 92 is pivotably coupled to a flange 114 extending downwardly from the foot end of seat section 42. As output shaft 102 retracts relative to housing 104 of actuator 92, end 112 pulls on flange 114 to pivot seat section 42 about axis 100. As seat section 42 moves toward the egress boost position, the portion of mattress 22 above seat section 42 is moved in the direction of arrow 116, shown in FIG. 4, to help push a patient up and out of bed 10.

Also, as seat section 42 moves from the horizontal position to the egress boost position, head actuator 90 is actuated to pivot head section 40 relative to the head end of seat section 42 about an axis 118 to increase an angle β defined between upper surfaces of head section 40 and seat section 42. As head section 40 moves in this manner, an output shaft 120 of actuator 90 retracts into a housing 122 of actuator 90 in the direction of arrow 124, shown in FIG. 4.

A first end 126 of actuator 90 is pivotably coupled to a flange 128 extending downwardly from the head end of seat section 42 and a second end 130 of actuator 90 is pivotably coupled to a flange 132 extending outwardly from the back of head section 40. As output shaft 120 retracts relative to housing 122 of actuator 90, end 130 pulls on flange 132 to pivot head section 40 about axis 118. As head section 40 pivots relative to seat section 42 about axis 118, the portion of mattress 22 above head section 40 is moved in the direction of arrow 134, shown in FIG. 4, to help push a patient up and out of bed 10. Thus, in the embodiment of FIGS. 3 and 4, the combined movement of head section 40 and seat section 42 in the directions of arrows 116, 134, respectively, helps move the patient to a standing position from bed 10.

Figure 5:
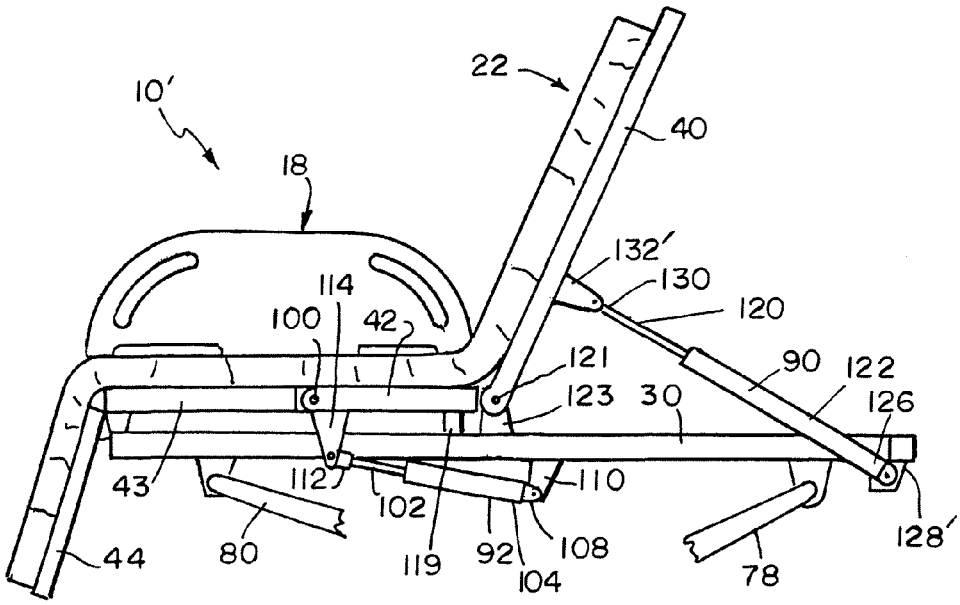
FIG. 5 is a diagrammatic side view, similar to FIG. 3, of the hospital bed having an alternative embodiment of a mattress support deck showing the mattress support deck in a chair egress position with a seat section and thigh section in generally horizontal positions on the upper frame of the hospital bed.
Figure 6:
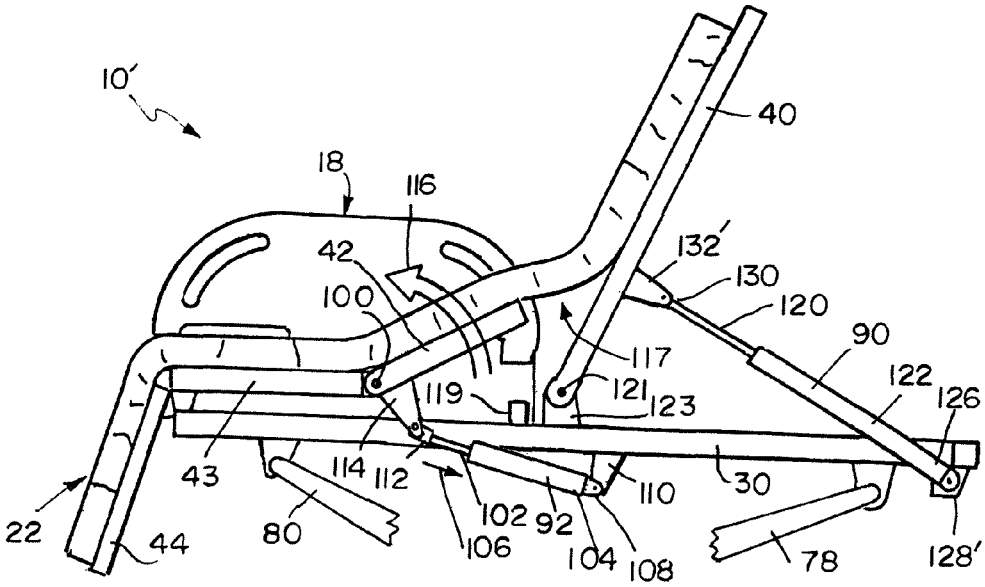
FIG. 6 is a diagrammatic side view, similar to FIG. 5, showing the mattress support deck in an egress boost position having the seat section pivoted upwardly relative to the upper frame about a foot end axis of the seat section and the head section remaining in the same position relative to the upper frame as in FIG. 5.

Referring now to FIGS. 5 and 6, an alternative embodiment bed 10' also has an egress boost feature but, in this embodiment, head section 40 is not coupled to seat section 42 and remains stationary in its raised position relative to upper frame 30 as seat section 42 moves from a horizontal position, shown in FIG. 5, to an egress boost position, shown in FIG. 6. Bed 10' is similar to bed 10 and so like reference numerals are used to denote like components. In the FIGS. 5 and 6 embodiment, actuator 92 operates to move seat section 42 to the egress boost position in the same manner as in the FIGS. 3 and 4 embodiment.

During egress boost, seat actuator 92 of bed 10' is actuated so that seat section 42 pivots about axis 100 located near the foot end of seat section 42 which causes the head end of seat section 42 to raise upwardly relative to upper frame 30 in the direction of arrow 116 as shown in FIG. 6. As seat section 42 moves toward the egress boost position, the portion of mattress 22 above seat section 42 is moved in the direction of arrow 116, shown in FIG. 6, as well to help push a patient up and out of bed 10. However, because head section 40 remains stationary relative to upper frame 30 in the bed 10' embodiment, a portion of mattress 22 bridges a gap 117 that opens up between the head end of seat section 42 and head section 40 as shown in FIG. 6. When seat section 42 is in the horizontal position, the head end region of seat section 42 rests atop a post or pedestal 119 as shown in FIG. 5.

In the bed 10' embodiment of FIGS. 5 and 6, head actuator 90 is actuated to pivot head section 40 about an axis 121 relative to a flange 123 that extends upwardly from upper frame 30. Actuator 90 has an output shaft 120 that extends and retracts relative to housing 122 of actuator 90 to pivot head section 40 about axis 121. A first end 126 of actuator 90 is pivotably coupled to a flange 128' extending downwardly from the head end of upper frame 30 and a second end 130 of actuator 90 is pivotably coupled to a flange 132' extending outwardly from the back of head section 40. Thus, in the embodiment of FIGS. 5 and 6, the movement of seat section 42 in the directions of arrow 116 helps move the patient to a standing position from bed 10'.

Figure 7:
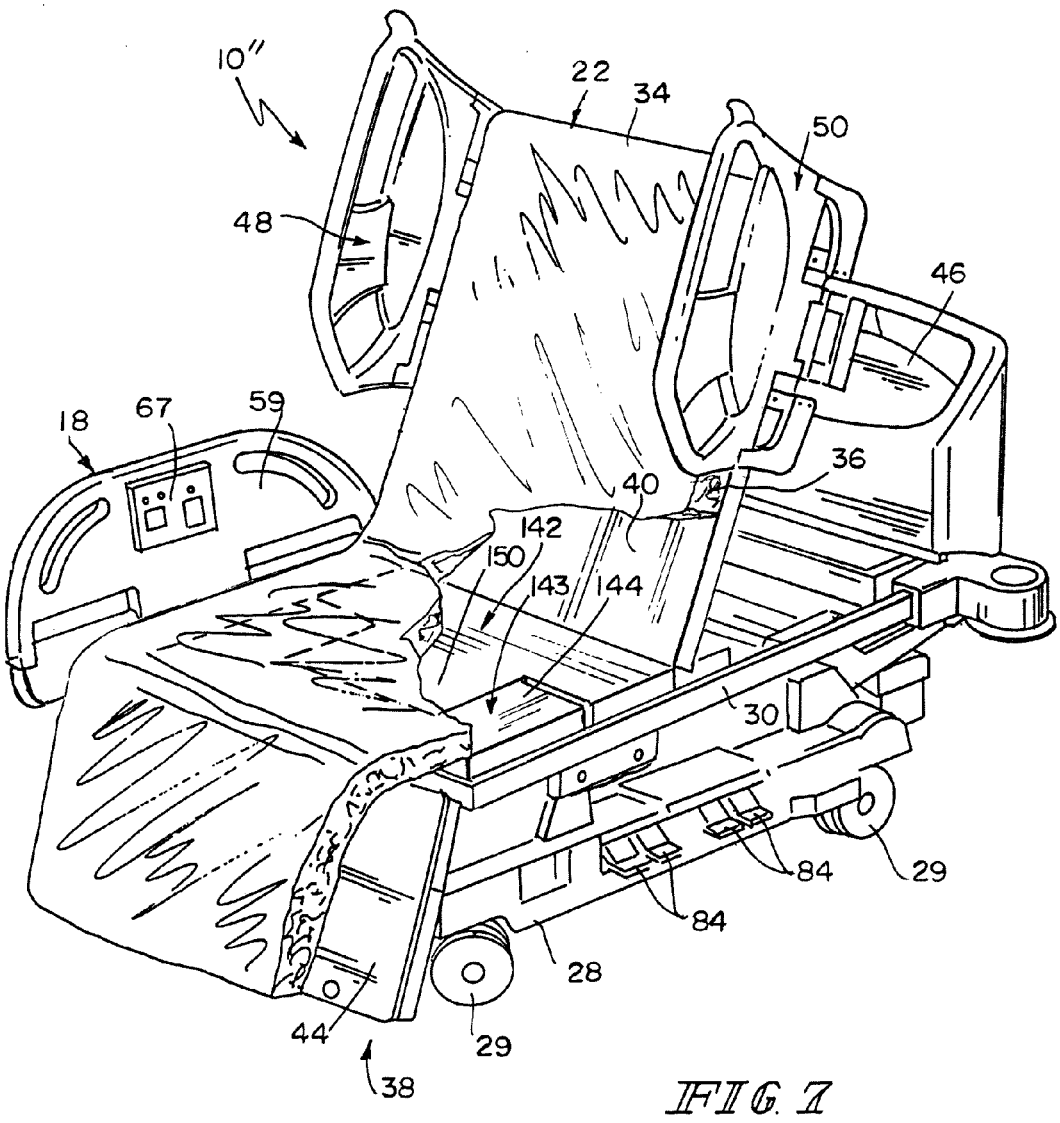
FIG. 7 is a perspective view, similar to FIG. 2, of the hospital bed having another alternative embodiment of a mattress support deck showing a T-shaped seat section having an extension portion received in a central gap of a U-shaped thigh section.
Figure 8:
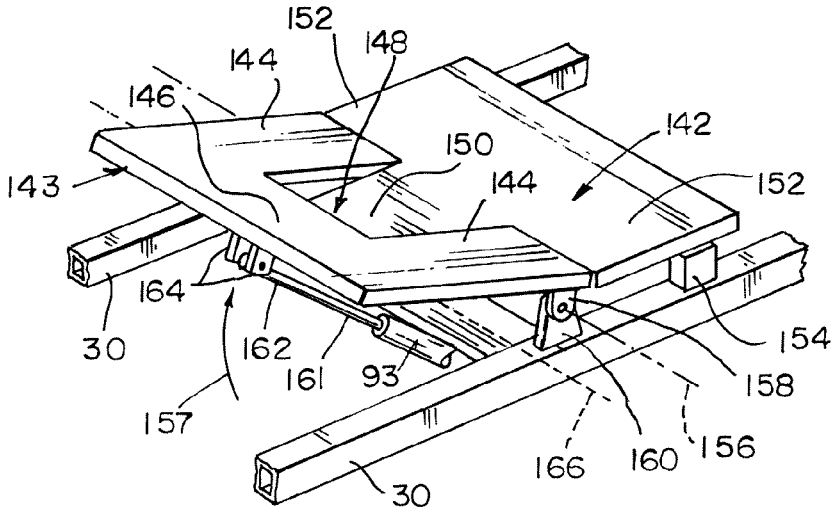
FIG. 8 is a perspective view of the T-shaped seat section and U-shaped thigh section showing the U-shaped thigh section pivoted upwardly about an axis at a head end of the U-shaped thigh section and the T-shaped seat section remaining in a horizontal position on the upper frame of the hospital bed.
Figure 9:
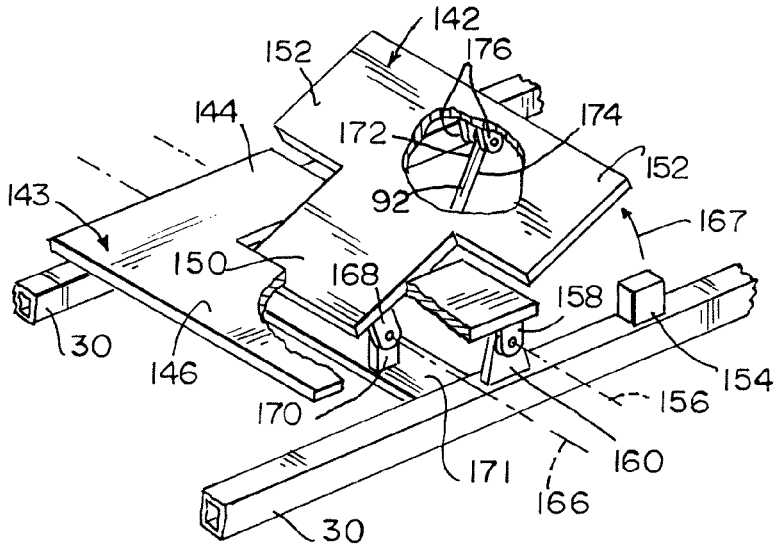
FIG. 9 is a perspective view, similar to FIG. 8, showing the T-shaped seat section pivoted upwardly about an axis at a foot end of the extension portion of the seat section to place the T-shaped seat section in an egress boost position and the U-shaped thigh section remaining in a horizontal position on the upper frame of the hospital bed.

Referring now to FIGS. 7-9, another alternative bed 10" also has an egress boost feature but, in this embodiment, an alternative seat section 142 is T-shaped and an alternative thigh section 143 is U-shaped. The U-shaped thigh section 143 has a pair of side portions 144 and a foot end portion 146 that interconnects side portions 144 as shown best in FIGS. 8 and 9. A central gap 148 is defined between side portions 144. The T-shaped seat section 142 includes an extension portion 150 received in the central gap 148 when the seat and thigh sections 142, 143 are in a horizontal position as shown in FIG. 7. Seat sections 142 includes a pair of side portions 152 that rest upon respective posts or pedestals 154 when seat section 142 is in a lowered position relative to upper frame 30 as shown in FIG. 8 (only one of pedestals 154 can be seen in FIG. 8).

The lateral width of seat section 142 across side portions 152 and the lateral width of thigh section 143 are substantially equal. Furthermore, extension portion 150 of seat section 142 is sized to substantially fill the central gap 148 of thigh section 143 when seat and thigh sections 142, 143 are both in the lowered position relative to upper frame 30. Thus, extension portion 150 of seat section 142 nests within gap 148 of thigh section 143 such that T-shaped seat section 142 and U-shaped thigh section 143 form an interdigitated arrangement.

Thigh section 143 is pivotable upwardly to a knee gatch position relative to upper frame 30 about a thigh section axis 156 located adjacent the head end of the thigh section 143 as shown in FIG. 8. As thigh section 143 moves to the knee gatch position, the foot end of thigh section 143 moves upwardly in the direction of arrow 157 relative to upper frame 30. In the illustrative example, flanges 158 extending downwardly from the head end of thigh section 143 are pinned to flanges 160 extending upwardly from upper frame 30 such that the pinned connection between flanges 158, 160 defines axis 156. Also in the illustrative example, an end 162 of an output shaft 161 of thigh actuator 93 is pivotably coupled to a pair of flanges 164 extending downwardly from the foot end of thigh section 143. When thigh section 143 is raised to the knee gatch position, a majority of the central gap 148 of thigh section 143 moves to a position above extension portion 150 of the seat section 142 as shown in FIG. 8.

Seat section 142 is pivotable upwardly to an egress boost position relative to upper frame 30 about a seat section axis 166 located adjacent the foot end of seat section 142 as shown in FIG. 9. As seat section 142 moves to the egress boost position, the head end of seat section 142 moves upwardly in the direction of arrow 167 relative to upper frame 30 such that side portions 152 of seat section 142 lift up off of the underlying pedestals 154. In the illustrative example, flanges 168 extending downwardly from the foot end of seat section 142 are pinned to flanges 170 extending upwardly from a cross member 171 of upper frame 30 such that the pinned connection between flanges 168, 170 defines axis 166. Also in the illustrative example, an end 172 of an output shaft 174 of seat actuator 92 is pivotably coupled to a pair of flanges 176 extending downwardly from the head end of seat section 142. Thus, in the embodiment of FIGS. 7-9, the movement of seat section 142 in the directions of arrow 167 helps move the patient to a standing position from bed 10".

When U-shaped thigh section 143 is raised to the knee gatch position, a portion of mattress 22 bridges across central gap 148. However, the mattress 22 has sufficient rigidity that it does not appreciably or noticeably bow or sag down into gap 148. Also, side portions 144 of thigh section 143 are located beneath portions of mattress 22 that typically support the thighs of the patient on bed 10". Furthermore, when seat section 142 is raised to the egress boost position, portions of mattress laterally overhang the opposite sides of extension portion 150. However, the mattress 22 has sufficient rigidity that the overhanging side portions of mattress 22 do not appreciably or noticeably sag down when seat section 142 is raised to the egress boost position. Also, extension portion 150 is located beneath the portion of the mattress that typically supports the buttocks or pelvic region of the patient on bed 10".

In a further alternative embodiment, the positions of the U-shaped section 143 and T-shaped section 142 are reversed. That is, the thigh section in this alternative embodiment is T-shaped, rather than U-shaped, and the seat section in this alternative embodiment is U-shaped, rather than T-shaped. The description above of FIGS. 8 and 9 is equally applicable to the reverse arrangement having a U-shaped seat section and T-shaped thigh section but, of course, any of the discussion of seat section 142 with regard to FIGS. 8 and 9 would now be applicable to the T-shaped thigh section of the alternative embodiment, and any discussion of thigh section 143 with regard to FIGS. 8 and 9 would now be applicable to the U-shaped seat section of the alternative embodiment.

Figure 12:
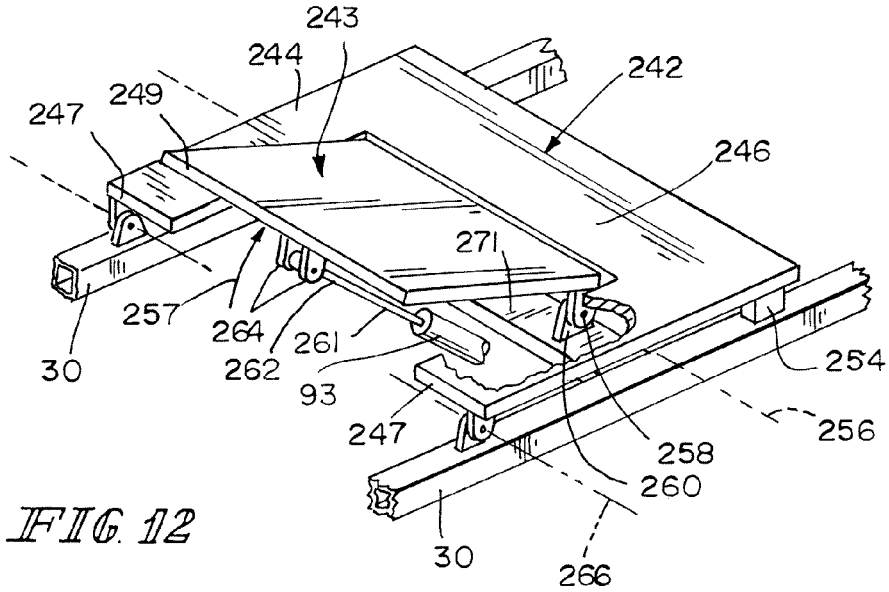
FIG. 12 is a perspective view of an alternative embodiment having a U-shaped seat section and a rectangular thigh section showing the seat section lowered and the thigh section raised.
Figure 13:
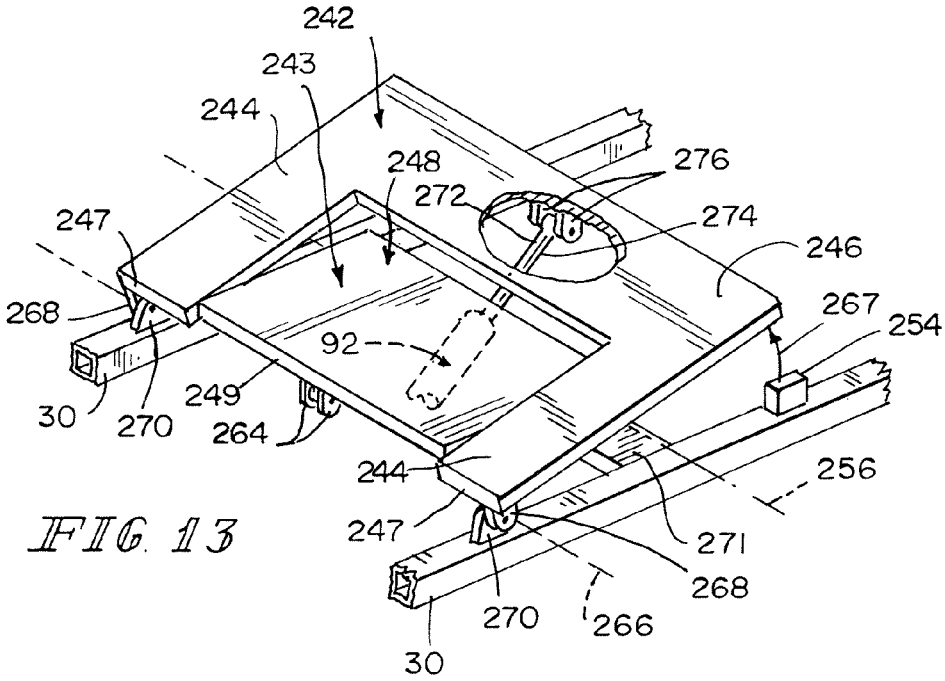
FIG. 13 is a perspective view of the alternative embodiment of FIG. 12 showing the seat section raised and the thigh section lowered.

Referring now to FIGS. 12 and 13, yet another alternative embodiment according to this disclosure has an egress boost feature but, in this embodiment, an alternative seat section 242 is U-shaped and an alternative thigh section 243 is rectangular. The U-shaped seat section 242 has a pair of side portions 244 and a head end portion 246 that interconnects side portions 244. A central gap 248 is defined between side portions 244. The rectangular thigh section 243 is received in the central gap 248 when the seat and thigh sections 242, 243 are in a horizontal position. In the illustrative example, thigh section 243 is sized to substantially fill the central gap 248 such that laterally extending foot end edges 247 of side portions 244 of seat section 242 and a laterally extending foot end edge 249 of thigh section 243 are substantially aligned when sections 242, 243 are both in their respective lowered positions relative to upper frame 30. In other embodiments, the thigh section is longer in the longitudinal dimension of the associated bed such that a foot end portion of the alternative thigh section extends beyond the central gap 248 of seat section 242 toward the foot end of the bed.

Seat section 242 rests upon respective posts or pedestals 254 when seat section 242 is in a lowered position relative to upper frame 30 as shown in FIG. 12 (only one of pedestals 254 can be seen in FIG. 12). Thigh section 243 is pivotable upwardly to a knee gatch position relative to upper frame 30 about a thigh section axis 256 located adjacent the head end of the thigh section 243 as shown in FIG. 12. As thigh section 243 moves to the knee gatch position, the foot end of thigh section 243 moves upwardly in the direction of arrow 257 relative to upper frame 30. In the illustrative example, flanges 258 extending downwardly from the head end of thigh section 243 are pinned to flanges 260 extending upwardly from a cross member 271 of upper frame 30 such that the pinned connection between flanges 258, 260 defines axis 256. Also in the illustrative example, an end 262 of an output shaft 261 of thigh actuator 93 is pivotably coupled to a pair of flanges 264 extending downwardly from the foot end of thigh section 243. When thigh section 243 is raised to the knee gatch position, a majority of the central gap 248 of seat section 242 is no longer occupied by thigh section 243 as shown in FIG. 12.

Seat section 242 is pivotable upwardly to an egress boost position relative to upper frame 30 about a seat section axis 266 located adjacent the foot end of seat section 242 as shown in FIG. 13. As seat section 242 moves to the egress boost position, the head end of seat section 242 moves upwardly in the direction of arrow 267 relative to upper frame 30 such that corner regions of seat section 242 lift up off of the underlying pedestals 254. In the illustrative example, flanges 268 extending downwardly from the foot end of seat section 242 are pinned to flanges 270 extending upwardly from upper frame 30 such that the pinned connection between flanges 268, 270 defines axis 266. Also in the illustrative example, an end 272 of an output shaft 274 of seat actuator 92 is pivotably coupled to a pair of flanges 276 extending downwardly from the head end of seat section 242. Thus, in the embodiment of FIGS. 12 and 13, the movement of seat section 242 in the directions of arrow 267 helps move the patient to a standing position from the associated bed.

When thigh section 243 is raised to the knee gatch position, portions of mattress 22 overhang the opposite sides of thigh section 243. However, the mattress 22 has sufficient rigidity that it does not appreciably or noticeably bow or sag down into the spaces laterally outboard of thigh section 243. Furthermore, when seat section 242 is raised to the egress boost position, portions of mattress 22 bridge across the central gap 258 between side portions 244. However, the mattress 22 has sufficient rigidity that the portion of mattress 22 over gap 248 does not appreciably or noticeably sag down into the gap 248 when seat section 242 is raised to the egress boost position.

Referring now to FIG. 10, two additional features of bed 10 that further facilitate egress of the patient from the bed when deck 38 is in the chair egress position are illustrated diagrammatically. Beds 10', 10" implement these same two features in some embodiments. In the FIG. 10 example, upper frame 30 is tilted relative to horizontal by an angle θ to a reverse Trendelenburg position. As a result, foot section 44 also tilts by an additional angle θ relative to vertical when deck 38 is in the chair egress position. Thus, if foot section moves through an angle α of say about 88 to about 90 degrees from the horizontal position when upper frame 30 is horizontal, then moving upper frame 30 through an angle θ of say about 5 degrees has the effect of moving foot section 44 though a total angle of about 93 to 95 degrees.

Thus, in the FIG. 10 embodiment, foot section 44 is pivoted to such an extent that it folds slightly underneath thigh section 43 and inclines slightly in the head end direction of bed 10. This allows the patient to bend their knees by greater than 90 degrees during egress from bed 10 which is a more ergonomic and comfortable position from which to stand. Thus, in the embodiment of FIG. 10, during egress from bed 10, the patient's hips are higher in elevation than the patient's knees due to moving upper frame 30 to the reverse Trendlenburg position and the patient's heels are at a position behind (i.e., further back) than the patient's knees due to foot section pivoting by more than 90 degrees from the horizontal position.

As shown diagrammatically in FIG. 11, bed 10 includes control circuitry 98 that is electrically coupled to motors 90, 92, 93, 94, 96 and to motors 70 of lift system 32. Beds 10', 10" have similar control circuitry 98 and so the description below is equally applicable to the various bed embodiments disclosed herein. Control circuitry 98 is represented diagrammatically as a single block 98 in FIG. 11, but control circuitry 98 in some embodiments comprises various circuit boards, electronics modules, and the like that are electrically and communicatively interconnected. Control circuitry 98 includes one or more microprocessors 200 or microcontrollers that execute software to perform the various control functions and algorithms described herein. Thus, circuitry 98 also includes memory 202 for storing software, variables, calculated values, and the like as is well known in the art.

As also shown diagrammatically in FIG. 11, graphical display screen 66 is coupled to control circuitry 98. Another block represents the other user inputs of bed 10, such as inputs 67, 84, for example, that are used by the caregiver or patient to communicate input signals to control circuitry 98 of bed 10 to command the operation of the various motors 70, 90, 92, 93, 94, 96 of bed 10, as well as commanding the operation of other functions of bed 10. Bed 10 has an egress boost user input 204 to command seat motor 92 and head motor 90 in the FIGS. 3 and 4 embodiment, to move seat section 42 to the egress boost position. In some embodiments, input 204 comprises a button, such as a membrane switch, on one or more of side rails 16, 18, 48, 50 and/or end boards 45, 46. Alternatively or additionally, input 204 is included as a button or icon that is touched on graphical display screen 66.

In some embodiments, such as the illustrative embodiment, control circuitry 98 of bed 10 communicates with a remote computer device 206 via communication infrastructure 208 such as an Ethernet of a healthcare facility in which bed 10 is located and via communications links 210, 212 as shown diagrammatically in FIG. 11. Computer device 206 is sometimes simply referred to as a "computer" herein. Remote computer 206 is part of an electronic medical records (EMR) system in some contemplated embodiments and is part of a nurse call system, a physician ordering system, an admission/discharge/transfer (ADT) system, or some other system used in a healthcare facility in other embodiments. Ethernet 208 in FIG. 11 is illustrated diagrammatically and is intended to represent all of the hardware and software that comprises a network of a healthcare facility.

In the illustrative embodiment, bed 10 has a communication interface or port 214 which provides bidirectional communication via link 212 with infrastructure 208 which, in turn, communicates bidirectionally with computer 206 via link 210. Link 212 is a wired communication link in some embodiments and is a wireless communications link in other embodiments. Thus, communications link 212, in some embodiments, comprises a cable that connects bed 10 to a wall mounted jack that is included as part of a bed interface unit (BIU) or a network interface unit (NIU) of the type shown and described in U.S. Pat. Nos. 7,538,659 and 7,319,386 and in U.S. Patent Application Publication Nos. 2009/0217080 A1, 2009/0212925 A1 and 2009/0212926 A1, each of which is hereby expressly incorporated by reference herein. In other embodiments, communications link 212 comprises wireless signals sent between bed 10 and a wireless interface unit of the type shown and described in U.S. Patent Application Publication No. 2007/0210917 A1 which is hereby expressly incorporated by reference herein. Communications link 210 comprises one or more wired links and/or wireless links as well. In some embodiments, each time the chair egress function of bed 10 is used, information regarding that use is transmitted to computer 210 by control circuitry 98 for display and/or storage.

Although certain illustrative embodiments have been described in detail above, many embodiments, variations and modifications are possible that are still within the scope and spirit of this disclosure as described herein and as defined in the following claims.

The invention claimed is:

1. A hospital bed comprising a base, an upper frame supported above the base, a deck supported on the upper frame, the deck having a head section, a seat section, a thigh section, and a foot section, the deck being movable between a horizontal position to support a patient in a supine position and a chair egress position to support the patient in a sitting position, and a seat section actuator coupled to the seat section and operable to articulate the seat section relative to the upper frame about an axis located adjacent a foot end of the seat section such that a head end of the seat section lifts upwardly relative to the upper frame to facilitate egress of the patient from the deck when the deck is in the chair egress positions wherein the head section is coupled to the upper frame for pivoting movement about a head section axis that remains stationary relative to the upper frame as the head end of the seat section lifts upwardly relative to the upper frame.

2. The hospital bed of claim 1, wherein the head section is coupled to the seat section adjacent the head end of the seat section and further comprising a head section actuator that operates to increase an angle defined between the head section and the seat section as the seat section actuator lifts the head end of the seat section upwardly relative to the upper frame.

3. The hospital bed of claim 2, wherein the head section actuator has a first end coupled to a first link extending from the head section and a second end coupled to a second link extending from the seat section.

4. The hospital bed of claim 1, wherein a gap between the head end of the seat section and a foot end of the head section increases in size as the seat section lifts upwardly relative to the upper frame.

5. The hospital bed of claim 1, further comprising a head section actuator having a first end pivotably coupled to the head section and a second end pivotably coupled to the upper frame.

6. The hospital bed of claim 5, wherein the seat section actuator has a first end pivotably coupled to the seat section and a second end pivotably coupled to the upper frame.

7. The hospital bed of claim 1, wherein the foot section moves through an angle greater than 90 degrees as the deck moves between the horizontal and chair egress positions.

8. The hospital bed of claim 7, wherein the foot section moves through the angle greater than 90 degrees due to pivoting of the foot section relative to the thigh section and due to the upper frame being tilted relative to the base.

9. The hospital bed of claim 1, wherein one of the seat section and the thigh section is U-shaped having a central gap and the other of the seat section and the thigh section is T-shaped with an extension portion received in the central gap when the seat and thigh sections are in a substantially coplanar orientation.

10. The hospital bed of claim 9, wherein the axis about which the seat section articulates to lift the head end of the seat section upwardly is situated adjacent a foot end of the seat section.

11. The hospital bed of claim 9, wherein the thigh section is pivotable upwardly to a knee gatch position relative to the upper frame about a thigh section axis located adjacent a head end of the thigh section such that a majority of the extension portion is located outside the central gap.

12. The hospital bed of claim 11, wherein the seat section is T-shaped and the thigh section is U-shaped and further comprising a mattress, a portion of the mattress bridging across the central gap when the thigh section is in the knee gatch position.

13. The hospital bed of claim 9, wherein an inclination of the thigh section remains stationary relative to the upper frame as the deck moves between the horizontal and chair egress positions.

14. The hospital bed of claim 1, further comprising a head section actuator to move the head section, a thigh section actuator to move the thigh section and a foot section actuator to move the foot section.

15. The hospital bed of claim 14, wherein the foot section includes a first portion, a second portion that is extendable and retractable relative to the first portion, and an extension actuator to extend and retract the second portion relative to the first portion.

16. The hospital bed of claim 1, wherein the axis about which the seat section articulates relative to the upper frame remains at a fixed position relative to the upper frame during seat section articulation.

17. The hospital bed of claim 1, wherein the upper frame includes a pair of spaced apart, longitudinally extending frame members and the seat section includes a pair of outer lateral portions that rest upon the longitudinally extending frame members of the upper frame when the deck is in the horizontal position.

18. The hospital bed of claim 17, wherein the pair of outer lateral portions of the seat section move upwardly away from the longitudinally extending frame members when the seat section articulates as the deck moves toward the chair egress position.

19. The hospital bed of claim 1, wherein the head section is coupled to the upper frame for pivoting movement about a laterally extending head section axis that translates longitudinally relative to the upper frame as the head end of the seat section lifts upwardly relative to the upper frame and as the head section pivots upwardly relative to the upper frame during movement of the deck from the horizontal position to the chair egress position.

20. A hospital bed comprising a base, an upper frame supported above the base, a deck supported on the upper frame, the deck having a head section, a seat section, a thigh section, and a foot section, the deck being movable between a horizontal position to support a patient in a supine position and a chair egress position to support the patient in a sitting position, and a seat section actuator coupled to the seat section and operable to articulate the seat section relative to the upper frame about an axis located adjacent a foot end of the seat section such that a head end of the seat section lifts upwardly relative to the upper frame to facilitate egress of the patient from the deck when the deck is in the chair egress position, wherein the head section is coupled to the upper frame for pivoting movement about a head section axis that is spaced from the axis located adjacent the foot end of the seat section, wherein a vertical elevation of the head section axis relative to the upper frame remains constant as the head end of the seat section lifts upwardly relative to the upper frame.

* * * * *